United States Patent [19]

Skrzipek et al.

[11] 4,108,557

[45] Aug. 22, 1978

[54] ERROR CORRECTING TYPEWRITER

[75] Inventors: Jürgen Skrzipek, Berlin; Helge Reuter, Nuremberg, both of Fed. Rep. of Germany

[73] Assignee: Triumph Werke Nurnberg A.G., Nuremberg, Fed. Rep. of Germany

[21] Appl. No.: 767,537

[22] Filed: Feb. 10, 1977

[30] Foreign Application Priority Data

Feb. 14, 1976 [DE] Fed. Rep. of Germany ..... 2606013
Jul. 22, 1976 [DE] Fed. Rep. of Germany ..... 2633021

[51] Int. Cl.[2] ..... B41J 29/16

[52] U.S. Cl. ..... 400/697.1; 400/368; 400/466; 400/310; 400/312

[58] Field of Search ..... 197/151, 156, 181, 91

[56] References Cited

U.S. PATENT DOCUMENTS

| | | | |
|---|---|---|---|
| 3,204,746 | 9/1965 | Wolowitz | 197/181 X |
| 3,724,633 | 4/1973 | Korb et al. | 197/181 X |
| 3,729,081 | 4/1973 | Ozimek et al. | 197/181 X |
| 3,780,846 | 12/1973 | Kolpek et al. | 197/181 X |
| 3,788,442 | 1/1974 | Lehnhardt et al. | 197/181 |
| 3,799,316 | 3/1974 | Davidge et al. | 197/181 |
| 3,862,679 | 1/1975 | Ozimek et al. | 197/181 |
| 3,866,736 | 2/1975 | Ozimek et al. | 197/181 |
| 3,905,465 | 9/1975 | Frechette et al. | 197/181 |

FOREIGN PATENT DOCUMENTS

| | | | |
|---|---|---|---|
| 1,071,959 | 6/1967 | United Kingdom | 197/181 |

*Primary Examiner*—Ernest T. Wright, Jr.
*Attorney, Agent, or Firm*—Joseph R. Spalla

[57] ABSTRACT

An error correction system for a typewriter in which a silent type action with a blank type face is operatively connected and synchronized to initiate a backspace action and elevate and feed an error correction ribbon in advance of the striking of the blank type face against the space wherein an error was printed. Thus, to obliterate an error and type in a correct character, an operator need only perform two operations; depress the error key and the correct character key. Further, in accordance with the invention, the error key may be further depressed to a repeat position whereby a series of characters may be obliterated automatically.

5 Claims, 3 Drawing Figures

ERROR CORRECTING TYPEWRITER

This invention relates to an error correcting typewriter; more particularly, it relates to an error correcting typewriter having an error correction keylever for initiating the operation of a silent type action having an obliterating or blank type face, an action operable to initiate backspacing of a typewriter carriage, an error correction ribbon and means for elevating and feeding the error correction ribbon; and specifically, to an error correcting typewriter wherein connections are provided between the error correction keylever to initiate a backspace action, to effect error correction ribbon elevation and to feed the error correction ribbon in sequence in advance of impact of the type face associated with the silent key action initiated by the depression of the error correction keylever.

Error correction systems known to the prior art require multiple manipulative steps by an operator to obliterate or erase an incorrect character and thereafter to type a correct character.

In accordance with the invention, an error correction keylever associated with a silent action having a blank type face is provided. This action is functionally associated with a backspace keylever and with an error correction ribbon elevator as well as an error correction ribbon feed mechanism whereby a single error correction keylever depression serves to backspace the carriage, elevate and feed error correction ribbon, and impact a blank type face against the platen through the error correction ribbon, to erase by covering or removing a character typed in error. Following error key depression and release, the correct character is typed in the same character space and normal typing resumed.

The arrangement is realized in a particularly simple manner by means of a control shaft which is actuated by the error correction keylever and in turn actuates the backspace action and the correction ribbon system in advance of printing of the blank type face.

It is an object of the invention, therefore, to simplify and accelerate operator error correction procedure so that only the type key corresponding to the correct character to be typed has to be actuated after actuation of an error correction keylever.

Another object of the invention is in the provision of an error correction system whereby a series of characters can be erased by a single depression of an error correction keylever to a repeat position thereby effecting repeat backspace and repeat error erase actions.

Other objects, features and advantages of the present invention will become apparent to those skilled in the art from a reading of the following detailed description of a preferred embodiment when taken in conjunction with the accompanying drawing wherein like reference numerals designate like or corresponding parts throughout the several views thereof and wherein.

Figure 1:
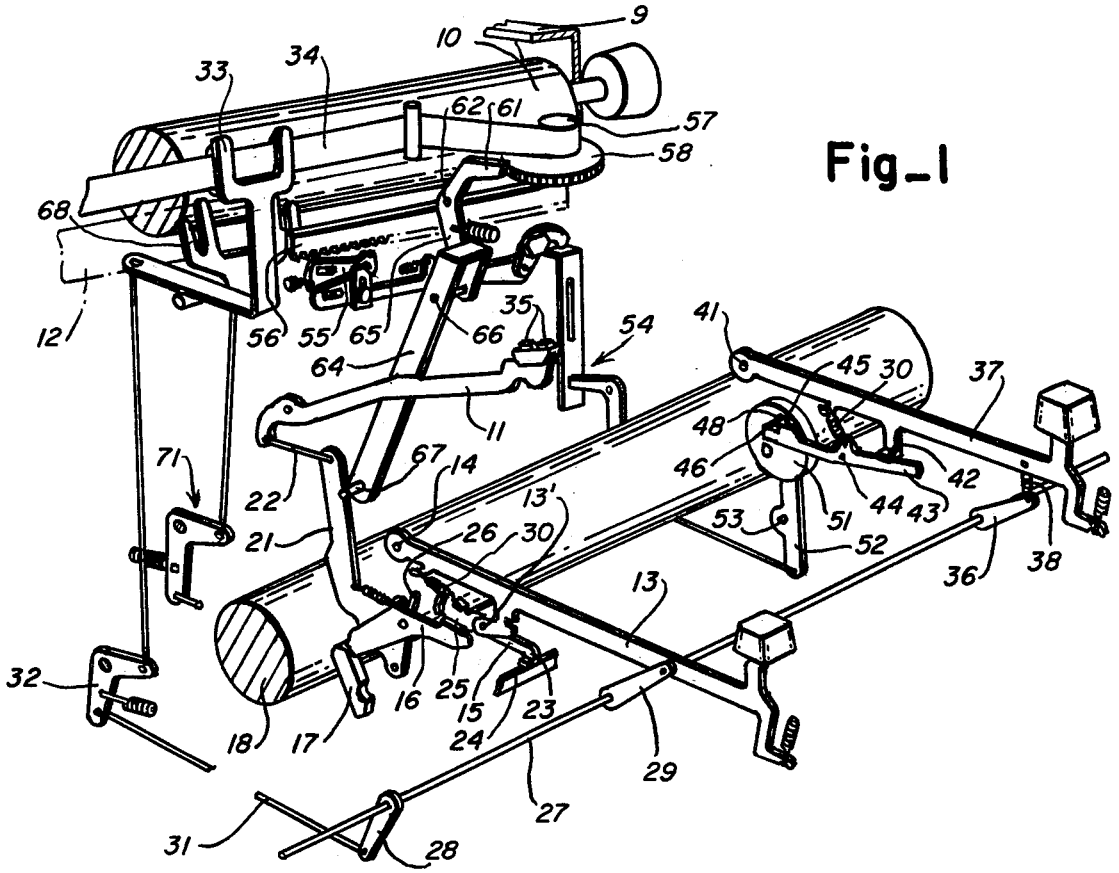
FIG. 1 is a perspective view schematically showing only the essential elements of a typebar typewriter embodying Applicants' invention.

Referring now to the drawing, there is shown in FIG. 1 a carriage 9 which supports a platen 10 against which type faces on typebars 11 are impacted through an inked ribbon 12 to type a line of characters. As is well known, incident to movement of a typebar 11 to print, carriage escapement mechanism (not shown) as well as inked ribbon elevation and feed mechanism (not shown) are operated by elements of the type action.

As shown in FIG. 1, among a plurality of keylevers operable to initiate type actions is an error correction keylever 13 which is pivotally mounted as at 14 and is effective incident to depression to a first limit position FLP (shown in full lines in FIG. 2), to cause a release lever 15 connected by a spring 30 to the keylever 13 to rock and thereby rotate a cam lever 16 supporting an eccentric cam 17 into engagement with a rotating power roll 18. The engagement of the cam 17 with the power roll 18 causes a sublever 21 to which the cam lever 16 is pivoted to be driven clockwise, as shown, and, via a link 22, to drive the typebar 11 toward the platen 10.

Figure 2:
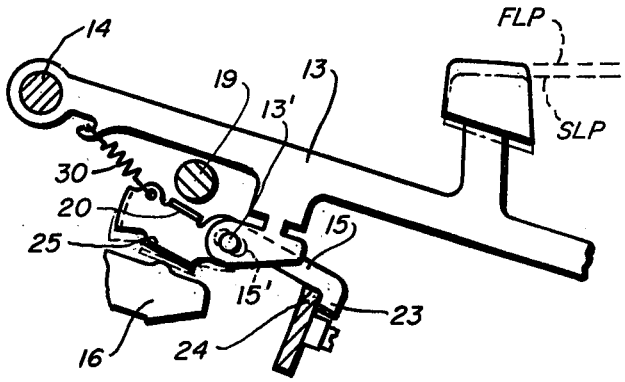
FIG. 2 is an active elevational view showing in greater detail the action of the release lever when the error correction keylever in FIG. 1 is depressed to a first limit position (full lines) and to a second limit or repeat position (dotted lines)

As shown in FIGS. 1 and 2, the release lever 15 is pivotally and slidably or translatably connected intermediate its end to the error correction keylever 13 as by a pin 13' in the keylever 13 and a slot 15' on the release lever 15. In the path of the forward hooked end 23 of the release lever 15 is an abutment 24 whose upper surface, incident to keylever depression, causes the release lever 15 to rock counterclockwise about its pin and slot connection 13',15' to the keylever 13 causing its rear end 25 to engage and rock the cam lever 16 clockwise whereby the type action is initiated. Incident to the power driven movement of the sublever 21, a portion 26 thereby engages and translates the release lever 15 forwardly to the position shown in FIG. 2 whereby its hooked end 23 will be held against restoration to the rest position shown in FIG. 1 by the abutment 24 to preclude the initiation of a second type action, should the keylever 13 remain depressed at a first limit position FLP when the action is restored as shown in FIG. 2. However, should the keylever 13 be depressed to a second limit position SLP, illustrated by dotted lines in FIG. 2, the reaction with the upper surface of abutment 24 will cause the translated release lever 15 to be rocked farther to a position to repeatedly retrigger the type action for as long as the keylever 13 is held depressed to the second limit position SLP upon release of keylever 13, a lip 20 on the release lever will engage a cross shaft 19 (FIG. 2) thereby to disengage release lever 15 from abutment 24.

Conventionally, a carriage escapement is tripped incident to each type action to allow the carriage 9 to move to the next character space. The escapement is conventionally tripped when an abutment on a typebar strikes a universal escapement bar. In accordance with the invention, the typebar 11, shown associated with the error correction keylever 13, will not be so formed with the result that the universal escapement bar will not be tripped and no escapement will result from the action initiated by the error correction keylever 13, i.e. the erase action will be "silent".

As shown in FIG. 1, the error correction keylever 13 is linked to an arm 29 connected to rock a control shaft 27. Also rigidly connected to the control shaft 27 is an arm 28 which is connected by a link 31 to a crank 32 which in turn is linked to a forked error correction ribbon vibrator 33 whereby depression of the error keylever 13 will cause the error correction ribbon vibrator 33 to elevate to position the guided error correction ribbon 34 in the path of the type faces 35 on the typebar 11. In accordance with the invention, the upper and lower case type faces 35 are blank type faces of the size of a full character space as will overlap a typed character, thereby, where the error correction ribbon 34 carries white transfer material, to cover over a typed character with white ink, or, where the error correction ribbon 34 carries adhesive material, to pull off a typed character. To enhance erasure, the blank type faces 35 may be finely serrated with serrations.

As shown in FIG. 1, the control shaft 27 also rigidly carries another arm 36 which is linked to pull down a backspace keylever 37 whereby a conventional backspace action will be initiated. The connection to the backspace keylever 37, shown as a spring 38, will allow the backspace keylever 37 to be depressed with no effect on the control shaft 27.

As shown, the backspace keylever 37, pivoted as at 41, has a depending foot 42 which, when the backspace keylever 37 is depressed, will rock a trip lever 43 clockwise about its pivot 44. The rear end of the trip lever 43 is formed with an upper offset primary stop 45 and a lower secondary stop 46 spaced rearwardly of the primary stop 45. In the rest position shown, the primary stop 45 lies in the path of a pin 48 on a cam 51 rotatably mounted eccentrically on a pivoted sublever 52 and biased to rotate into engagement with the power roll 18 when released, thereby to oscillate the sublever 52 about its pivot 53. The secondary stop 46 is to arrest the cam 48 following completion of a backspace action should the backspace keylever 37 be still depressed to a first limit thereby to preclude a repeat action. Should the trip lever 43 be rocked further clockwise as to move the secondary stop 46 out of the path of the pin 48 on the cam 51 as when the backspace keylever 37 is pulled to a second limit position, via the control shaft 27, when the error correction keylever 13 is depressed to a second limit, repeat backspace actions will ensue.

Oscillation of sublever 52 serves, through conventional linkage generally designated by reference 54, to elevate a backspace pawl 55 into a carriage rack 56 and to move the pawl 55 and carriage 9 in a backspace direction.

Also in accordance with the invention, an error correction ribbon take-up spool 57, having a toothed flange 58, is shown in association with spool indexing mechanism comprising a pawl 61 which is rockable clockwise about its pivot 62 in response to the rocking of a lever 64 acting against the lower end 65 of the pawl 61. The lever 64, which is pivoted at 66, has a pin 67 on its lower end in the path of the sublever 21 of the silent type action.

As shown, the error correction ribbon fork 33 is located farther from the platen 10 than an inked ribbon fork 68, though it might be located between the platen 10 and the inked ribbon fork 68. In the arrangement shown, elevation of the inked ribbon 12 would be precluded by not providing a projection on the sublever 21 which would be operative in a conventional manner on a ribbon U-bar (not shown) which operates to elevate the inked ribbon fork 68, via a train of partially shown linkage generally designated by reference 71, incident to a typing action. When the error ribbon fork 33 can be placed between the inked ribbon fork 68 and the platen 10, both ribbon forks 33, 68 may be elevated with the blank type face 35 striking through both ribbons 12 and 34.

Figure 3:
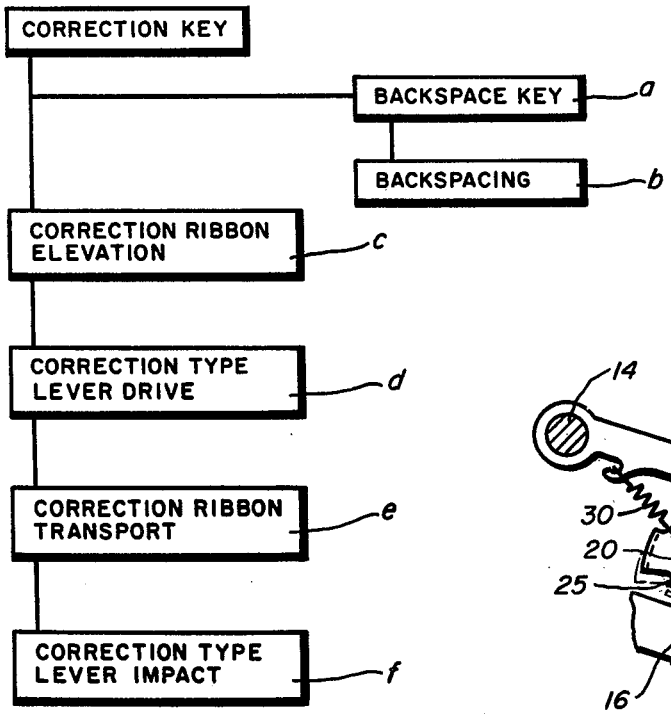
FIG. 3 is a view showing the sequence of operations incident to depression of the correction key.

Assuming the last character typed was in error and must be corrected, the carriage 9 will have moved one space following typing of the character in error. To erase the character typed in error, an operator need only depress the error correction keylever 13 to initiate the sequence of events a-f illustrated in FIG. 3, the elements of the structure described in FIG. 1 being so synchronized to provide the sequence. More particularly, depression of the error correction keylever 13 to a first limit position FLP will rotate the control shaft 27 which will pull down the backspace lever 37 with the result that a backspace action will be initiated and the carriage 9 will move the printing point to the space occupied by the character typed in error. Rotation of the control shaft 27 will also elevate the error correction ribbon fork 33 to position the error ribbon 34 opposite the printing point during which time the keylever initiated silent action typebar 11 is moving to impact the blank type face 35 against the platen 10. In advance of impact, the sublever 21 operates the pawl 61 to transport a fresh area of correction ribbon 33 opposite the printing point. Following erasure, the correction keylever 13 is released and as the error correction or erase action is silent, the correct character may then be typed in the same character space.

If repeated strikes are necessary to obliterate or remove deeply embedded characters, this may be done by operating the error correction keylever 13 and a space bar (not shown) alternately. Where a series of characters are to be erased, an operator need only depress the error correction keylever 13 to the second limit position SLP (shown in dotted lines in FIG. 2) whereby the sequence shown in FIG. 3, except for stops *a* and *c*, as the backspace key 37 remains depressed to the second limit and the error correction ribbon fork 33 remains elevated, will repeat until the keylever 13 is released.

While the invention is described with reference to a typebar typewriter, it is to be understood that the concept may be embodied in a single element typewriter having a blank type on the single element typehead.

What is claimed is:

1. An error correcting typewriter having an error correction ribbon, means for elevating said error correction ribbon opposite the printing point of a typewriter, means for feeding said error correction ribbon to present a fresh area for elevation opposite said printing point, a carriage, means for initiating a backspace action for backspacing said carriage, a silent type action having a blank type face, an error correction keylever depressible to a first limit position for initiating operation of said silent type action, and means responsive to depression of said error correction keylever to said first limit position for operating, in advance of the printing of said blank type face, in sequence, said backspace action, said error correction ribbon elevating means, and said error correction ribbon feeding means, whereby a previously typed character can be erased and a correct character typed in the same character space.

2. An error correcting typewriter as recited in claim 1, wherein said means responsive to depression of said error correction keylever for operating said error correction ribbon feeding means, comprises means in the path of and operative by said silent type action.

3. An error correcting typewriter as recited in claim 1, wherein said error correction keylever is depressible to a second limit position and wherein said means responsive to error correction keylever depression includes means for repeatedly initiating said silent type action and for repeatedly initiating said backspace action for as long as said error correction keylever is held depressed to the second limit position.

4. An error correcting typewriter as recited in claim 1, wherein said error correction keylever is depressible to a second limit position, said means for initiating a backspace action including a backspace keylever movable to first and second limit positions incident to movement of said error correction keylever to first and second limit positions, and means responsive to backspace keylever depression to said first and second limit positions for initiating respectively single and repeat backspace actions.

5. An error correcting typewriter as recited in claim 3, said means for initiating repeat silent type actions in response to depression of said error correction keylever to a second limit position including a release lever pivotally and slidably mounted intermediate its ends on said error correction keylever, an abutment in the path of one end of said release lever for rocking said release lever incident to depression of said error correction keylever to a first limit position thereby to initiate a silent type action, said silent type action translating said release lever, said abutment holding said translated release lever in a non-repeat position until release of said error correction keylever, said abutment being located to further rock said release lever incident to depression of said error correction keylever to a second limit position whereby repeat silent type actions and repeat backspacing will ensue for as long as said error correction keylever is held depressed to said second limit position.

* * * * *